US011841020B2

(12) United States Patent
Scala

(10) Patent No.: US 11,841,020 B2
(45) **Date of Patent: *Dec. 12, 2023**

(54) VARIABLE VOLUME RATIO SCREW COMPRESSOR

(71) Applicant: TRANE INTERNATIONAL INC., Davidson, NC (US)

(72) Inventor: Alberto Scala, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/720,818

(22) Filed: Apr. 14, 2022

(65) Prior Publication Data

US 2022/0299031 A1 Sep. 22, 2022

Related U.S. Application Data

(63) Continuation of application No. 16/232,687, filed on Dec. 26, 2018, now Pat. No. 11,306,721.

(51) Int. Cl.
*F03C 2/00* (2006.01)
*F03C 4/00* (2006.01)
(Continued)

(52) U.S. Cl.
CPC ..... *F04C 28/18* (2013.01); *F04C 18/16* (2013.01); *F04C 28/12* (2013.01); *F25B 31/026* (2013.01); *F25B 2600/0262* (2013.01)

(58) Field of Classification Search
CPC ..... F04C 28/10; F04C 28/12; F04C 28/14; F04C 28/18; F04C 18/16; F25B 2600/0262; F25B 31/026
See application file for complete search history.

(56) References Cited

U.S. PATENT DOCUMENTS 3,088,659 A 5/1963 Nilsson et al.
4,516,914 A * 5/1985 Murphy ..... F04C 28/125 418/201.2
(Continued)

FOREIGN PATENT DOCUMENTS

CN 104047853 A 9/2014
CN 105579709 A 5/2016
(Continued)

OTHER PUBLICATIONS

JPH10002288-A—Kishi—Slide Valve of Screw Type Hydraulic Machine—Jan. 6, 1998—English Machine Translation. (Year: 1998).*
(Continued)

*Primary Examiner* — Theresa Trieu
(74) *Attorney, Agent, or Firm* — Hamre, Schumann, Mueller & Larson, P.C.

(57) ABSTRACT

A screw compressor, method of operating, and refrigerant circuit are disclosed. The screw compressor includes a suction inlet that receives a working fluid to be compressed. A compression mechanism is fluidly connected to the suction inlet that compresses the working fluid. A discharge outlet is fluidly connected to the compression mechanism that outputs the working fluid following compression by the compression mechanism. A valve assembly is configured to vary a location at which the compression mechanism compresses the working fluid, the valve assembly being disposed to modify a suction location of the screw compressor.

12 Claims, 9 Drawing Sheets

(51) Int. Cl.

| | |
|---|---|
| ***F04C 18/00*** | (2006.01) |
| ***F04C 2/00*** | (2006.01) |
| ***F04C 28/18*** | (2006.01) |
| ***F04C 18/16*** | (2006.01) |
| ***F25B 31/02*** | (2006.01) |
| ***F04C 28/12*** | (2006.01) |

(56) References Cited

U.S. PATENT DOCUMENTS

| | | | | |
|---|---|---|---|---|
| 5,135,374 | A | 8/1992 | Yoshimura et al. | |
| 5,183,395 | A * | 2/1993 | Langouet | F04C 28/125 418/201.2 |
| 5,832,737 | A | 11/1998 | Moilanen | |
| 11,306,721 | B2 * | 4/2022 | Scala | F04C 18/16 |
| 2004/0109782 | A1 | 6/2004 | Tang et al. | |
| 2004/0234381 | A1 | 11/2004 | Hattori et al. | |
| 2008/0085180 | A1 | 4/2008 | Mackenzie et al. | |
| 2008/0206086 | A1 | 8/2008 | Bush | |
| 2012/0282129 | A1 | 11/2012 | Nemit | |
| 2013/0216414 | A1 | 8/2013 | Kopko et al. | |
| 2015/0093273 | A1 | 4/2015 | Johnson et al. | |
| 2018/0356139 | A1 | 12/2018 | Johnson et al. | |

FOREIGN PATENT DOCUMENTS

| | | | | | |
|---|---|---|---|---|---|
| CN | 107740769 | A | | 2/2018 | |
| DE | 102014000469 | A1 | | 7/2015 | |
| GB | 1237333 | A | | 6/1971 | |
| JP | S5397710 | U | | 8/1978 | |
| JP | 59131791 | A | | 7/1984 | |
| JP | 10002288 | A | * | 1/1998 | F04C 28/125 |
| JP | 2011-132835 | A | | 7/2011 | |
| WO | 2007/030114 | A1 | | 3/2007 | |

OTHER PUBLICATIONS

JP2011/132835A—Ueno—Screw Compressor—Jul. 7, 2011—English machine Translation. (Year: 2011).*

Extended European Search Report; European Patent Application 19216623.9, dated Feb. 17, 2020 (8 pages).

Office Action issued in Chinese Patent Application No. 201911367426.X, dated Oct. 19, 2022, with partial English translation (11 pages).

Office Action issued in Chinese Patent Application No. 201911367426.X, dated Jul. 22, 2023, with partial English translation (12 pages).

* cited by examiner

VARIABLE VOLUME RATIO SCREW COMPRESSOR

FIELD

This disclosure relates generally to a vapor compression system. More specifically, the disclosure relates to controlling a volume ratio of a compressor for a vapor compression system such as, but not limited to, a heating, ventilation, air conditioning, and refrigeration (HVACR) system.

BACKGROUND

One type of compressor for a vapor compression system is generally referred to as a screw compressor. A screw compressor generally includes one or more rotors (e.g., one or more rotary screws). Typically, a screw compressor includes a pair of rotors (e.g., two rotary screws) which rotate relative to each other to compress a working fluid such as, but not limited to, a refrigerant or the like.

SUMMARY

This disclosure relates generally to a vapor compression system. More specifically, the disclosure relates to controlling a volume ratio of a compressor for a vapor compression system such as, but not limited to, a heating, ventilation, air conditioning, and refrigeration (HVACR) system.

In an embodiment, the compressor is a screw compressor. In an embodiment, the screw compressor is used in an HVACR system to compress a working fluid (e.g., a heat transfer fluid such as, but not limited to, a refrigerant or the like).

In an embodiment, the screw compressor is actuated by a variable frequency drive (VFD).

In an embodiment, the screw compressor has a variable volume ratio. In an embodiment, the screw compressor is operable at a first volume ratio and at a second volume ratio. In an embodiment, the first volume ratio is relatively lower than the second volume ratio. In an embodiment, the volume ratio is controllable based on a valve assembly disposed on a suction side of the screw compressor.

In an embodiment, the valve assembly can be used to vary a location of the suction port.

A screw compressor is disclosed. The screw compressor includes a suction inlet that receives a working fluid to be compressed. A compression mechanism is fluidly connected to the suction inlet that compresses the working fluid. A discharge outlet is fluidly connected to the compression mechanism that outputs the working fluid following compression by the compression mechanism. A valve assembly is configured to vary a location at which the compression mechanism compresses the working fluid, the valve assembly being disposed to modify a suction location of the screw compressor.

A method of modifying a volume ratio of a screw compressor is disclosed. The method includes determining a discharge pressure of the screw compressor; and modifying a location of a suction port of the screw compressor in response to the discharge pressure of the screw compressor as determined. At a relatively higher discharge pressure a suction port is disposed so that compression begins relatively sooner than at a relatively lower discharge pressure.

A refrigerant circuit is disclosed. The refrigerant circuit includes a compressor, a condenser, an expansion device (e.g. valve, orifice, or the like), and an evaporator fluidly connected. The compressor includes a suction inlet that receives a working fluid to be compressed. A compression mechanism is fluidly connected to the suction inlet that compresses the working fluid. A discharge outlet is fluidly connected to the compression mechanism that outputs the working fluid following compression by the compression mechanism. A valve assembly is configured to vary a location at which the compression mechanism compresses the working fluid, the valve assembly being disposed to modify a suction location of the screw compressor.

BRIEF DESCRIPTION OF THE DRAWINGS

References are made to the accompanying drawings that form a part of this disclosure, and which illustrate embodiments in which the systems and methods described in this specification can be practiced.

Like reference numbers represent like parts throughout.

DETAILED DESCRIPTION

Figure 1:
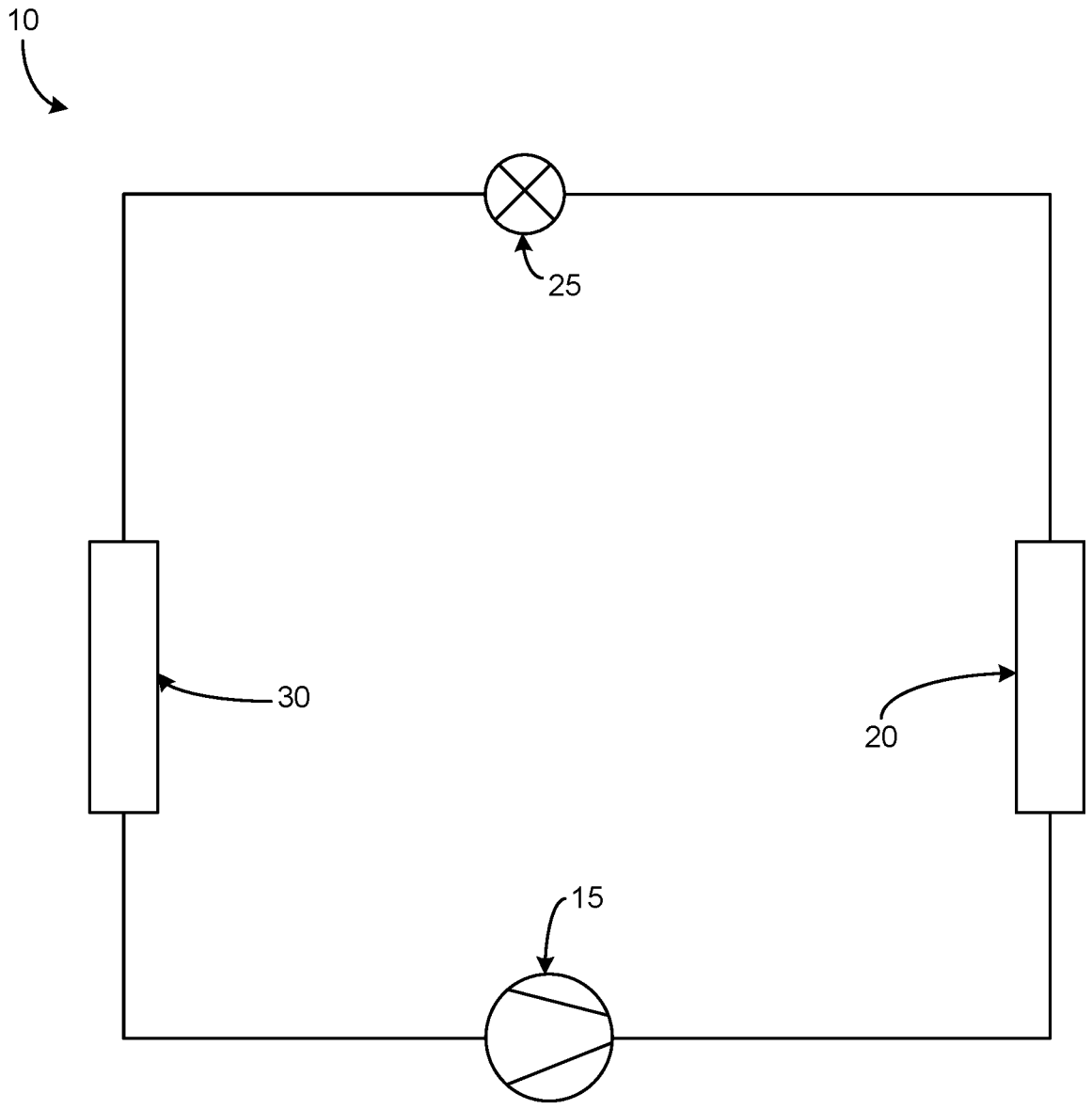
FIG. 1 is a schematic diagram of a heat transfer circuit, according to an embodiment.

This disclosure relates generally to a vapor compression system. More specifically, the disclosure relates to controlling a volume ratio of a compressor for a vapor compression system such as, but not limited to, a heating, ventilation, air conditioning, and refrigeration (HVACR) system.

In an embodiment, a volume ratio of a compressor, as used in this specification, is a ratio of a volume of working fluid at a start of a compression process to a volume of the working fluid at a start of discharging the working fluid. A fixed volume ratio compressor includes a ratio that is set, regardless of operating condition. A variable volume ratio can be modified during operation of the compressor (e.g., based on operating conditions, etc.).

Screw compressors generally have a fixed volume ratio. Typically, the screw compressors are designed to operate at a maximum efficiency when operating at a full load condition. As a result, when operated at conditions other than full load, the screw compressor may lose efficiency. For example, when a compressor is running at a part load operation, the compressor may over pressurize a working fluid.

In some instances, screw compressors may have a variable volume ratio. Generally, in order to vary the volume ratio, a location at which the compressed working fluid is discharged can be delayed so that the volume ratio of the compressor is modified.

Embodiments are described in which the discharge port of a screw compressor is fixed. Instead, a location at which the working fluid is provided for compression. In an embodiment, the location is the suction port which is configured to be varied. As a result, the volume ratio will change due to the variation of the suction port. In an embodiment, varying a location of the suction port can, for example, limit a range of speeds at which the motor is operated. In an embodiment, because the discharge port is fixed and not variable, the screw compressor may have reduced leakage and discharge pulsation than when the discharge port location is varied.

In an embodiment, a screw compressor can be actuated by a variable frequency drive (VFD). In an embodiment, the screw compressor can have a variable speed drive. The variable speed drive (which can also be referred to as a variable frequency drive) can be used, for example, to vary a capacity of the screw compressor. In such an embodiment, because the variable speed drive is used to vary the capacity, an unloading mechanism of the screw compressor can be modified to provide a variable volume ratio instead of to control capacity. In an embodiment, the screw compressor may not include a VFD. However, in such an embodiment, a benefit of the volume ratio modification may be reduced relative to an embodiment including a VFD.

Embodiments described can improve a reliability of the screw compressor. For example, when operating the screw compressor at relatively lower speeds, a minimum amount of lubrication may be challenging to maintain. As a result, a lifetime of bearings in the screw compressor may be reduced. Embodiments of this disclosure can result in a relatively higher minimum operating speed than prior compressors. As a result, speeds at which lubrication becomes a concern can be avoided. Thus a lifetime of the screw compressor can be increased.

FIG. 1 is a schematic diagram of a heat transfer circuit 10, according to some embodiments. The heat transfer circuit 10 generally includes a compressor 15, a condenser 20, an expansion device 25, and an evaporator 30. The compressor 15 can be, for example, a screw compressor such as the screw compressor shown and described in accordance with FIG. 2 below. The heat transfer circuit 10 is exemplary and can be modified to include additional components. For example, in some embodiments the heat transfer circuit 10 can include an economizer heat exchanger, one or more flow control devices, a receiver tank, a dryer, a suction-liquid heat exchanger, or the like.

The heat transfer circuit 10 can generally be applied in a variety of systems used to control an environmental condition (e.g., temperature, humidity, air quality, or the like) in a space (generally referred to as a conditioned space). Examples of systems include, but are not limited to, heating, ventilation, air conditioning, and refrigeration (HVACR) systems, transport refrigeration systems, or the like.

The components of the heat transfer circuit 10 are fluidly connected. The heat transfer circuit 10 can be specifically configured to be a cooling system (e.g., an air conditioning system) capable of operating in a cooling mode. Alternatively, the heat transfer circuit 10 can be specifically configured to be a heat pump system which can operate in both a cooling mode and a heating/defrost mode.

Heat transfer circuit 10 operates according to generally known principles. The heat transfer circuit 10 can be configured to heat or cool heat transfer fluid or medium (e.g., a liquid such as, but not limited to, water or the like), in which case the heat transfer circuit 10 may be generally representative of a liquid chiller system. The heat transfer circuit 10 can alternatively be configured to heat or cool a heat transfer medium or fluid (e.g., a gas such as, but not limited to, air or the like), in which case the heat transfer circuit 10 may be generally representative of an air conditioner or heat pump.

In operation, the compressor 15 compresses a heat transfer fluid (e.g., refrigerant or the like) from a relatively lower pressure gas to a relatively higher-pressure gas. The relatively higher-pressure and higher temperature gas is discharged from the compressor 15 and flows through the condenser 20. In accordance with generally known principles, the heat transfer fluid flows through the condenser 20 and rejects heat to a heat transfer fluid or medium (e.g., water, air, fluid, or the like), thereby cooling the heat transfer fluid. The cooled heat transfer fluid, which is now in a liquid form, flows to the expansion device 25. The expansion device 25 reduces the pressure of the heat transfer fluid. As a result, a portion of the heat transfer fluid is converted to a gaseous form. The heat transfer fluid, which is now in a mixed liquid and gaseous form flows to the evaporator 30. The heat transfer fluid flows through the evaporator 30 and absorbs heat from a heat transfer medium (e.g., water, air, fluid, or the like), heating the heat transfer fluid, and converting it to a gaseous form. The gaseous heat transfer fluid then returns to the compressor 15. The above-described process continues while the heat transfer circuit is operating, for example, in a cooling mode (e.g., while the compressor 15 is enabled).

Figure 2:
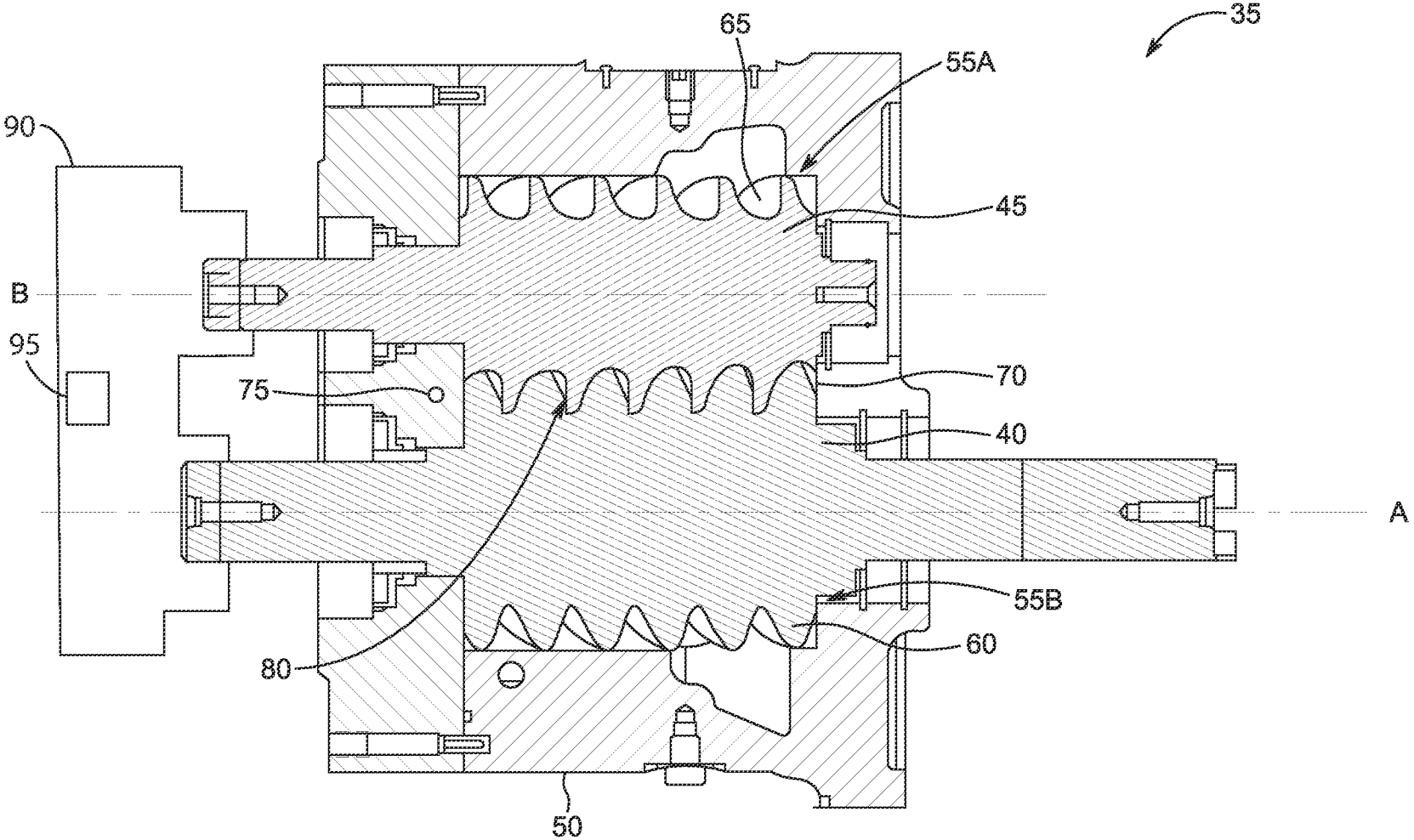
FIG. 2 illustrates a screw compressor with which embodiments as disclosed in this specification can be practiced, according to an embodiment.

FIG. 2 illustrates an embodiment of a screw compressor 35 with which embodiments as disclosed in this specification can be practiced. The screw compressor 35 can be used in the refrigerant circuit 10 of FIG. 1 (e.g., as the compressor 15). It is to be appreciated that the screw compressor 35 can be used for purposes other than in the refrigerant circuit 10. For example, the screw compressor 35 can be used to compress air or gases other than a heat transfer fluid or refrigerant (e.g., natural gas, etc.). It is to be appreciated that the screw compressor 35 includes additional features that are not described in detail in this specification. For example, the screw compressor 35 can include a lubricant sump for storing lubricant to be introduced to the moving components (e.g., motor bearings, etc.) of the screw compressor 35.

The screw compressor 35 includes a compression mechanism that includes a first helical rotor 40 and a second helical rotor 45 disposed in a rotor housing 50. The rotor housing 50 includes a plurality of bores 55A and 55B. The plurality of bores 55A and 55B are configured to accept the first helical rotor 40 and the second helical rotor 45.

The first helical rotor 40, generally referred to as the male rotor, has a plurality of spiral lobes 60. The plurality of spiral lobes 60 of the first helical rotor 40 can be received by a plurality of spiral grooves 65 of the second helical rotor 45, generally referred to as the female rotor. In an embodiment, the spiral lobes 60 and the spiral grooves 65 can alternatively be referred to as the threads 60, 65. The first helical rotor 40 and the second helical rotor 45 are arranged within the housing 50 such that the spiral grooves 65 intermesh with the spiral lobes 60 of the first helical rotor 40.

During operation, the first and second helical rotors 40, 45 rotate counter to each other. That is, the first helical rotor 40 rotates about an axis A in a first direction while the second helical rotor 45 rotates about an axis B in a second direction that is opposite the first direction. Relative to an axial direction that is defined by the axis A of the first helical rotor 40, the screw compressor 35 includes an inlet port 70 and an outlet port 75. The screw compressor 35 can include an electric motor 90 with a variable frequency drive 95 that mechanically drives the first and second helical rotors 40, 45.

The rotating first and second helical rotors 40, 45 can receive a working fluid (e.g., heat transfer fluid such as refrigerant or the like) at the inlet port 70. The working fluid can be compressed between the spiral lobes 60 and the spiral grooves 65 (in a pocket 80 formed therebetween) and discharged at the outlet port 75. The pocket is generally referred to as the compression chamber 80 and is defined between the spiral lobes 60 and the spiral grooves 65 and an interior surface of the housing 50. In an embodiment, the compression chamber 80 may move from the inlet port 70 to the outlet port 75 when the first and second helical rotors 40, 45 rotate. In an embodiment, the compression chamber 80 may continuously reduce in volume while moving from the inlet port 70 to the discharge port 80. This continuous reduction in volume can compress the working fluid (e.g., heat transfer fluid such as refrigerant or the like) in the compression chamber 80.

Figure 3A:
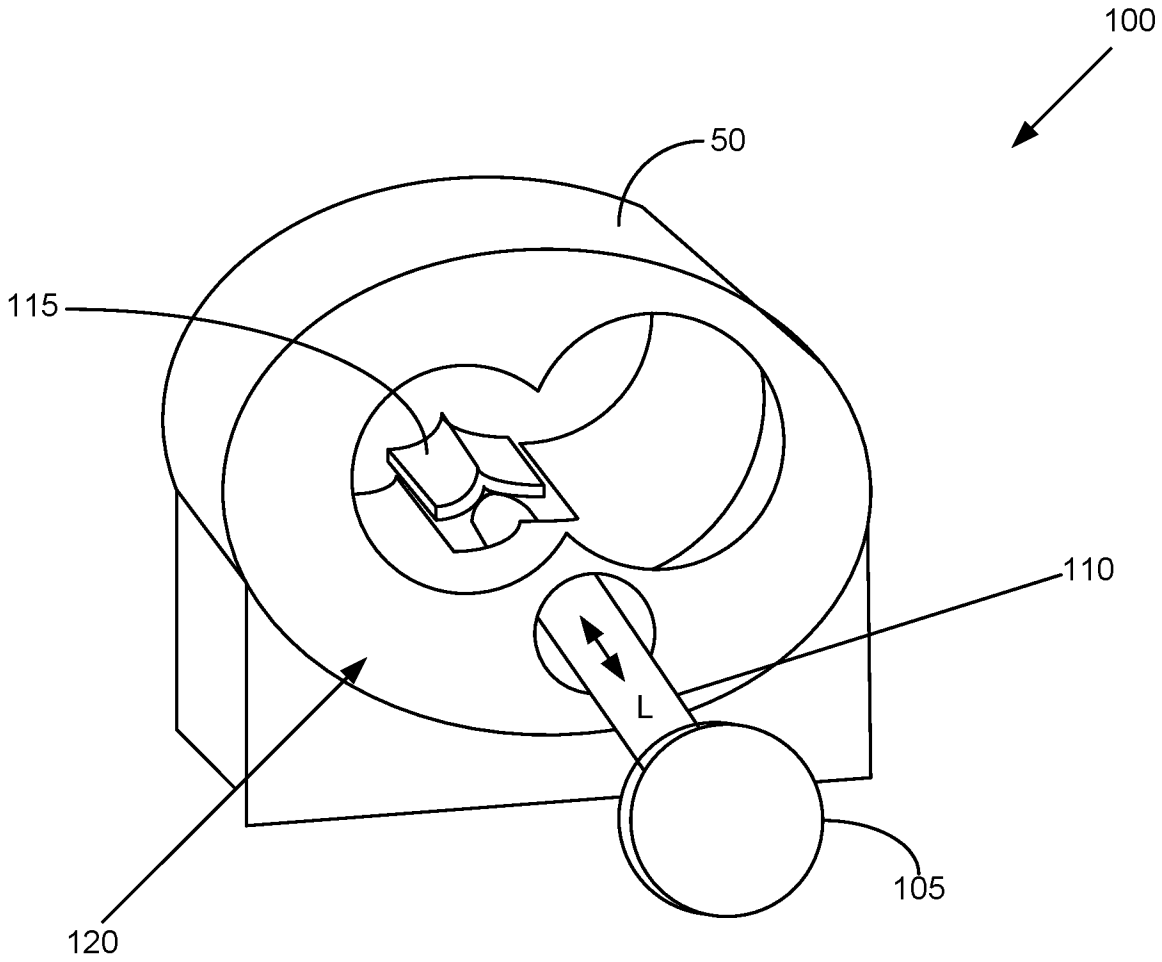
FIGS. 3A and 3B illustrate a valve assembly, according to an embodiment.
Figure 3B:
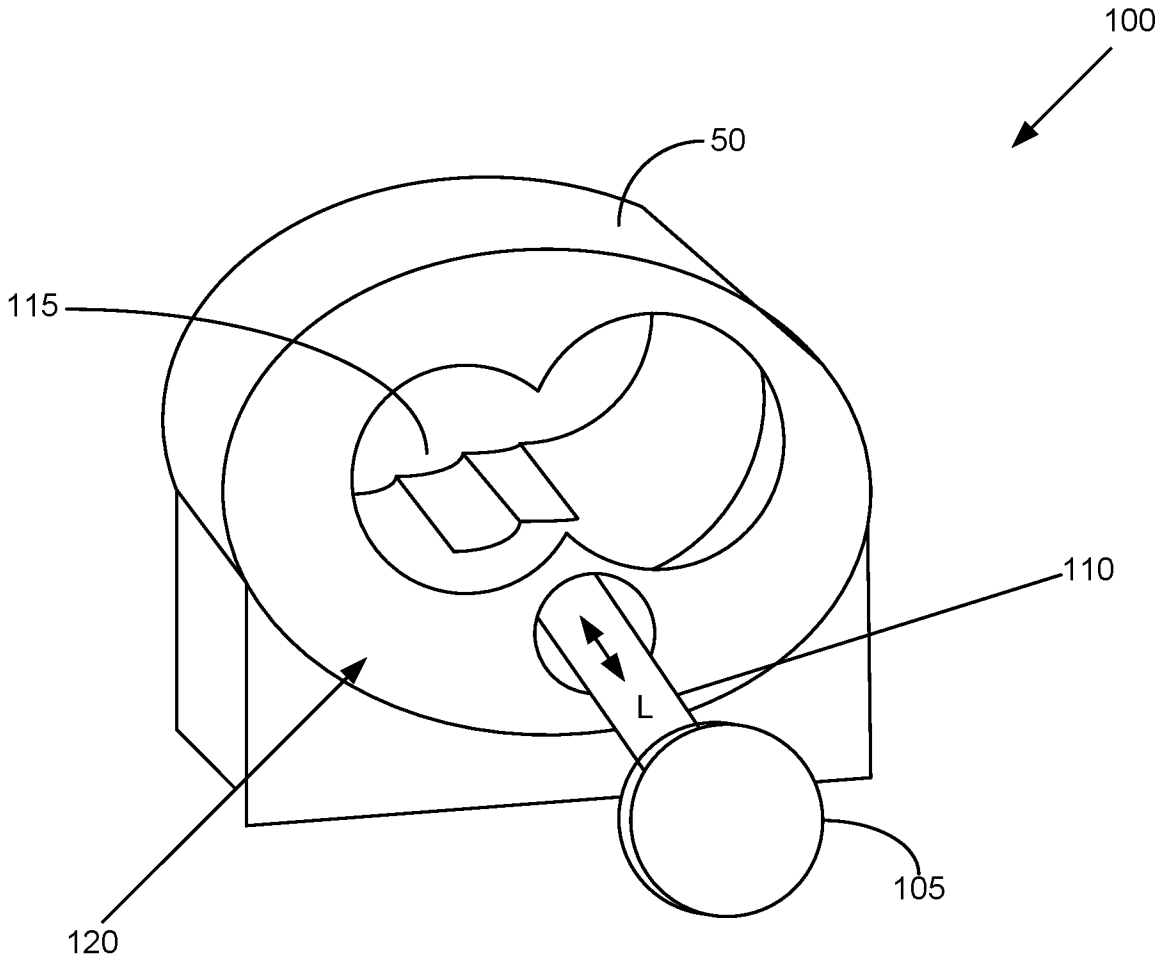

FIGS. 3A and 3B illustrate a valve assembly 100, according to an embodiment. In FIG. 3A, the valve assembly 100 is shown in a first position. In FIG. 3B, the valve assembly 100 is shown in a second position. FIGS. 3A and 3B will be referred to generally except where specifically indicated otherwise.

The valve assembly 100 can be utilized to modify a volume ratio of a screw compressor (e.g., the screw compressor 35 in FIG. 2). In an embodiment, the valve assembly 100 can vary a location of an axial suction port. In an embodiment, the screw compressor 35 having the valve assembly 100 can be included in a refrigerant circuit, such as the compressor 15 in the refrigerant circuit 10 of FIG. 1.

In the illustrated embodiment, the valve assembly 100 can be a sliding piston assembly. It is to be appreciated that the specific valve assembly 100 type can vary according to the principles of this Specification. Embodiments of valve assemblies are also shown and described in accordance with FIGS. 4A-4C, 5A, and 5B below.

The valve assembly 100 is movable in a longitudinal direction L so that a location at which compression begins is changeable. The longitudinal direction L is parallel to a rotational axis (e.g., axis A, axis B in FIG. 2) of rotors (e.g., rotors 40, 45 in FIG. 2) of the screw compressor 35. In an embodiment, varying the location at which compression begins can, for example, reduce an amount of overcompression of the working fluid when operating the screw compressor 35 at a part load operating condition.

In an embodiment, the valve assembly 100 has two functional positions. At a first position (as illustrated in FIG. 3A), the compression process is delayed, resulting in a relatively lower volume ratio for the screw compressor 35.

At a second position (as illustrated in FIG. 3B), the compression process begins relatively earlier than shown in FIG. 3A, resulting in a relatively higher volume ratio for the screw compressor 35.

In an embodiment, the screw compressor 35 with the valve assembly 100 in the first position (FIG. 3A) can have a relatively lower capacity than the screw compressor 35 with the valve assembly 100 in the second position (FIG. 3B). The variation in capacity may be relatively limited. For example, the capacity may vary between the first position and the second position by at or about 10 to at or about 20%. It is to be appreciated that the variation in capacity is also dependent on a speed of the screw compressor 35. For example, at a lower speed, the capacity variation may be relatively greater than at higher speed. The capacity change, when modifying the location at which compression begins, is in a same direction as the change to the volume ratio. That is, when moving from a relatively higher volume ratio (FIG. 3B) to a relatively lower volume ratio (FIG. 3A), the volume ratio decreases, and a resulting impact to the capacity may similarly be a decrease in the capacity. This is advantageous relative to modifying a discharge to impact the volume ratio, as lowering the volume ratio via the discharge modification can result in an inverse impact to capacity.

In an embodiment, intermediate positions between the first position (FIG. 3A) and the second position (FIG. 3B) may not provide a benefit as leakage may occur in an intermediate position. In an embodiment, a fluid path for the working fluid may be relatively too small in an intermediate position, which may induce an undesirable pressure drop.

A discharge pressure $P_D$ can be used to determine a location of the valve assembly 100. In an embodiment, when a discharge pressure $P_D$ is relatively lower, the valve assembly 100 may be disposed in the first position so that the compression process is delayed. As the discharge pressure $P_D$ increases, the valve assembly 100 can be moved toward the second position so that the compression process is not delayed (e.g., begins sooner). In an embodiment, a position sensor, a pressure on the valve assembly 100, or the like can also be used to determine the location of the valve assembly 100.

In an embodiment, the valve assembly 100 can be controlled passively. In an embodiment, the valve assembly 100 can be controlled actively, with an actuation mechanism (e.g., a solenoid or the like) other than the discharge pressure $P_D$.

In the illustrated embodiment, the valve assembly 100 is a slide piston assembly. The slide piston assembly can alternatively be referred to as a slide valve or the like. The valve assembly 100 includes a piston 105 having a connecting rod 110. The connecting rod 110 is also connected to a rotor sealing member 115. A working fluid can be provided to the piston 105 to move the connecting rod 110 and move the rotor sealing member 115 away from discharge end face 120 of rotor housing 50 to be in the first position (FIG. 3A) or to move the rotor sealing member 115 toward the discharge end face 120 to be in the second position (FIG. 3B).

When the valve assembly 100 is in the first position (FIG. 3A), the screw compressor 35 has a relatively lower volume ratio. In an embodiment, the lower volume ratio can reduce an amount of working fluid that is overcompressed when the screw compressor 35 is operating at a part load condition.

In an embodiment, when the valve assembly 100 is in the first position (FIG. 3A), a variable frequency drive (VFD) of the screw compressor 35 can be operated at a minimum speed that is relatively higher than a minimum speed when a discharge is modified to vary the volume ratio. As a result, the screw compressor 35 may operate at a relatively higher speed when at a lower volume ratio than prior compressors. This can in turn, for example, help ensure that lubricant provided to bearings of the screw compressor 35 does not decrease beyond an acceptable amount due to the reduced speeds. Thus the valve assembly 100 can, in an embodiment, increase a lifetime and reliability of the screw compressor 35.

Figure 4A:
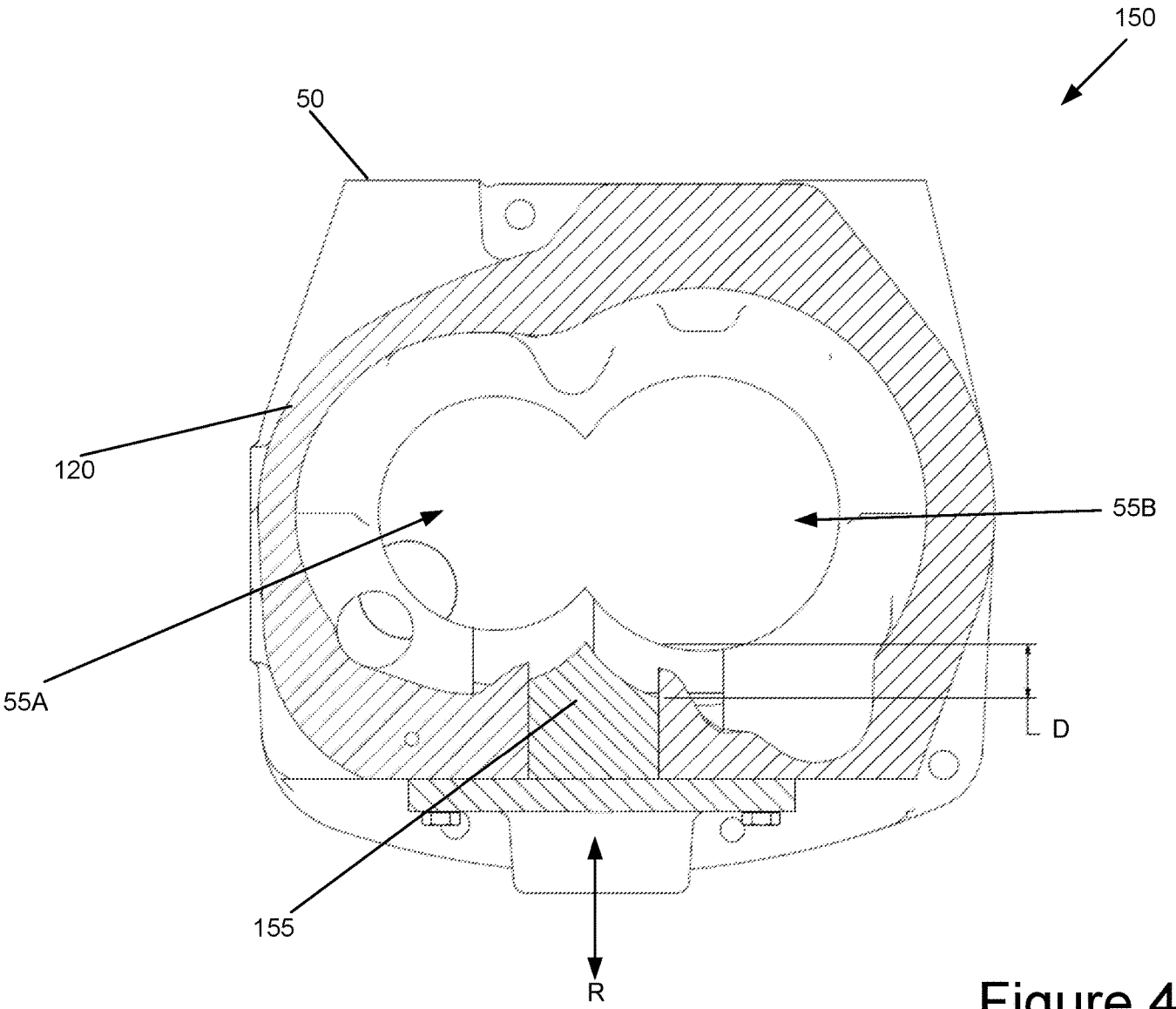
FIGS. 4A-4C illustrate a valve assembly, according to an embodiment.
Figure 4B:
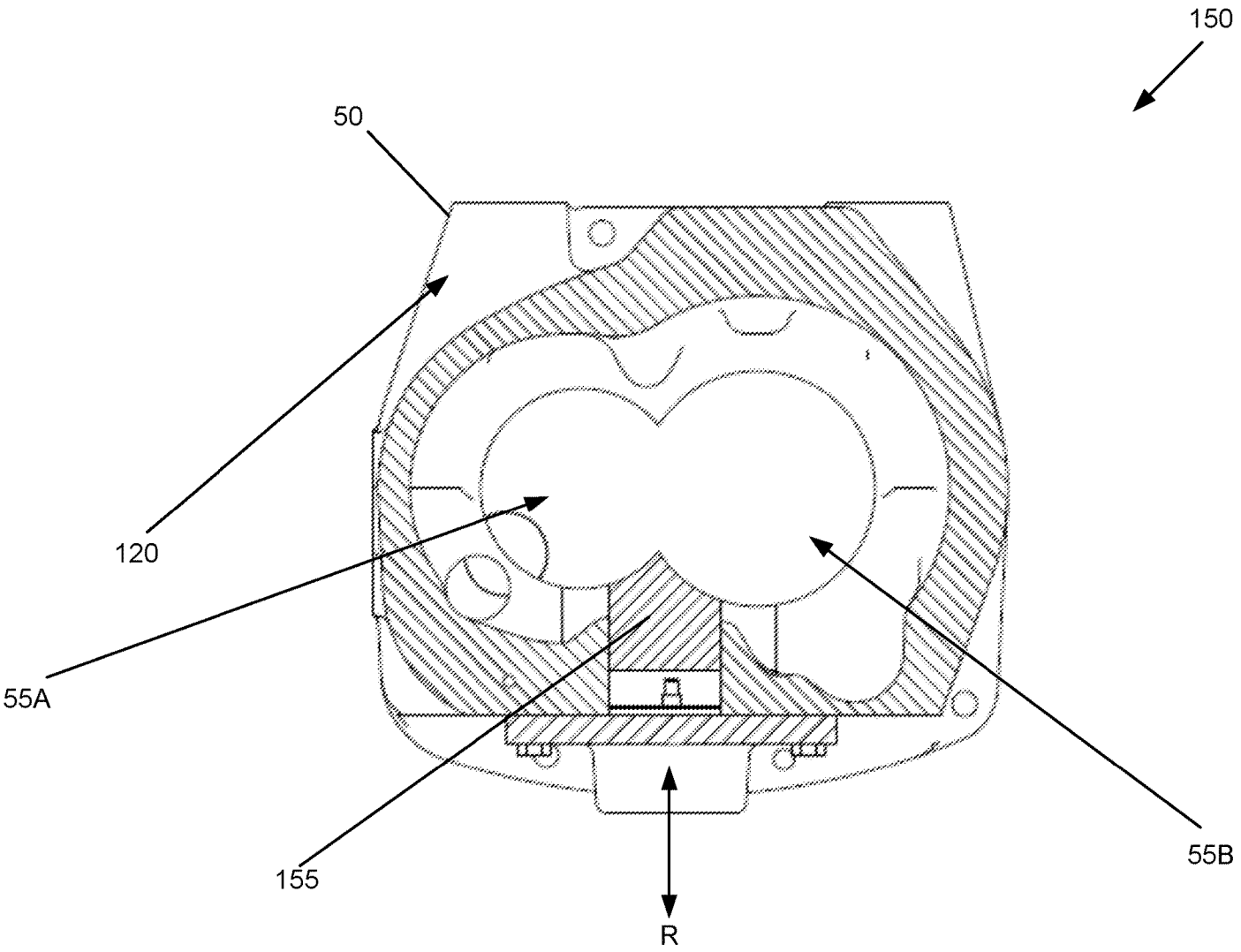
Figure 4C:
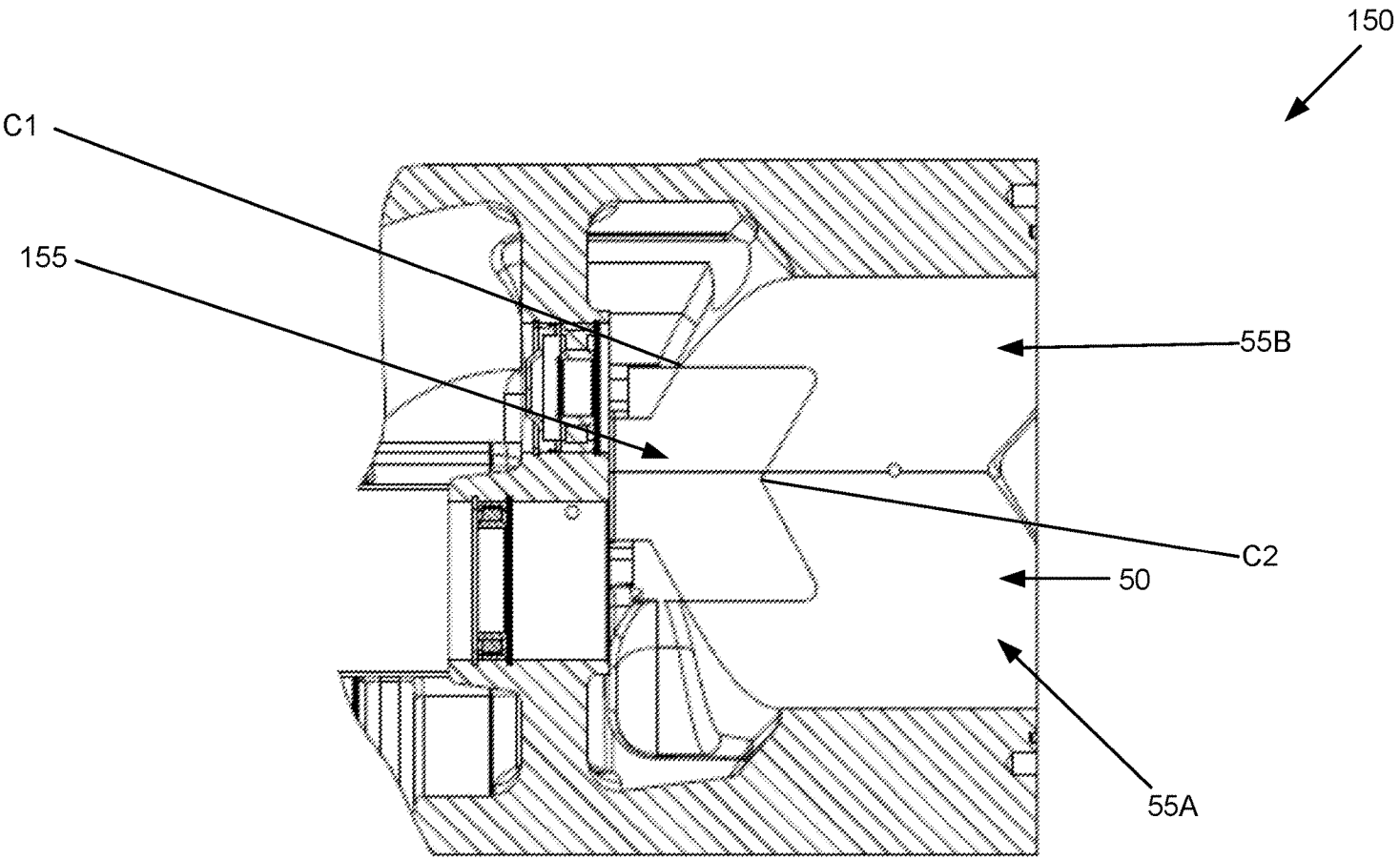

FIGS. 4A-4C illustrate a valve assembly 150, according to an embodiment. The valve assembly 150 can, for example, be utilized to modify a volume ratio of a screw compressor (e.g., the screw compressor 35 in FIG. 2). In an embodiment, the valve assembly 150 can vary a location of an axial suction port. In an embodiment, the screw compressor 35 having the valve assembly 150 can be included in a refrigerant circuit, such as the compressor 15 in the refrigerant circuit 10 of FIG. 1.

The valve assembly 150 can be included in the screw compressor 35 to modify a volume ratio of the screw compressor 35 at the suction side of the screw compressor 35. The valve assembly 150 can be used as an alternative to the valve assembly 100.

The valve assembly 150 is movable in a radial direction R so that a location at which compression begins is changeable. FIGS. 4A and 4B show a view from the discharge end 120. In FIG. 4C, the radial direction R is into and out of the page. In an embodiment, varying the location at which compression begins can, for example, reduce an amount of overcompression of the working fluid when operating the screw compressor 35 at a part load operating condition.

In an embodiment, the valve assembly 150 has two functional positions. At a first position (as illustrated in FIG. 4A), the compression process is delayed, resulting in a relatively lower volume ratio for the screw compressor 35. At a second position (as illustrated in FIG. 4B), the compression process begins relatively earlier than shown in FIG. 4A, resulting in a relatively higher volume ratio for the screw compressor 35. The valve assembly 150 can move a distance D between the first and the second position. The distance D can be based on, for example, a design of the screw compressor 35. In an embodiment, the screw compressor 35 with the valve assembly 150 in the first position can have a relatively lower capacity than the screw compressor with the valve assembly 150 in the second position. The variation in capacity may be relatively limited. For example, the capacity may vary between the first position and the second position by at or about 10 to at or about 20%.

In operation, the valve assembly 150 can be used to control a location at which the working fluid begins the compression process. There may be two positions (e.g., the first position and the second position) for the valve assembly 150. Intermediate positions between the first and second position may, for example, not provide a benefit, but instead cause leakage of the working fluid.

A discharge pressure $P_D$ can be used to determine a location of the valve assembly 150. In an embodiment, when a discharge pressure $P_D$ is relatively lower, the valve assembly 150 may be disposed in the first position so that the compression process is delayed. As the discharge pressure $P_D$ increases, the valve assembly 150 can be moved toward the second position so that the compression process is not delayed (e.g., begins sooner).

In an embodiment, the valve assembly 150 can be controlled passively. In an embodiment, the valve assembly 150 can be controlled actively, with an actuation mechanism other than the discharge pressure $P_D$.

In the illustrated embodiment, the valve assembly 150 is movable in a radial direction R. In an embodiment, the valve assembly 150 may be placed at a top of the rotor housing 50. In general, a location of the valve assembly 150 can be selected based on a location of the radial discharge port of the screw compressor 35. The valve assembly 150 includes a rotor sealing member 155. The rotor sealing member 155 can be moved between the first position and the second position to control the volume ratio of the screw compressor 35.

When the valve assembly 150 is in the first position, the screw compressor 35 has a relatively lower volume ratio. In an embodiment, the lower volume ratio can reduce an amount of working fluid that is overcompressed when the screw compressor 35 is operating at a part load condition.

FIG. 4C illustrates a sectional view of the valve assembly 150 in the screw compressor 35 to illustrate the various locations at which compression begins in the first position or in the second position, according to an embodiment. In an embodiment, the rotor sealing member 155 includes a profile that generally follows that of the bores (e.g., bores 55A, 55B FIG. 2) of the screw compressor 35. In operation, when the valve assembly 150 is in the first position, the rotor sealing member 155 may be disposed relatively into the page so that a compression process is delayed, and begins at or about a location C2. When the valve assembly 150 is in the second position, the rotor sealing member 155 may be disposed relatively flush with the bores 55A, 55B so that a compression process begins relatively earlier, at or about a location C1.

Figure 5A:
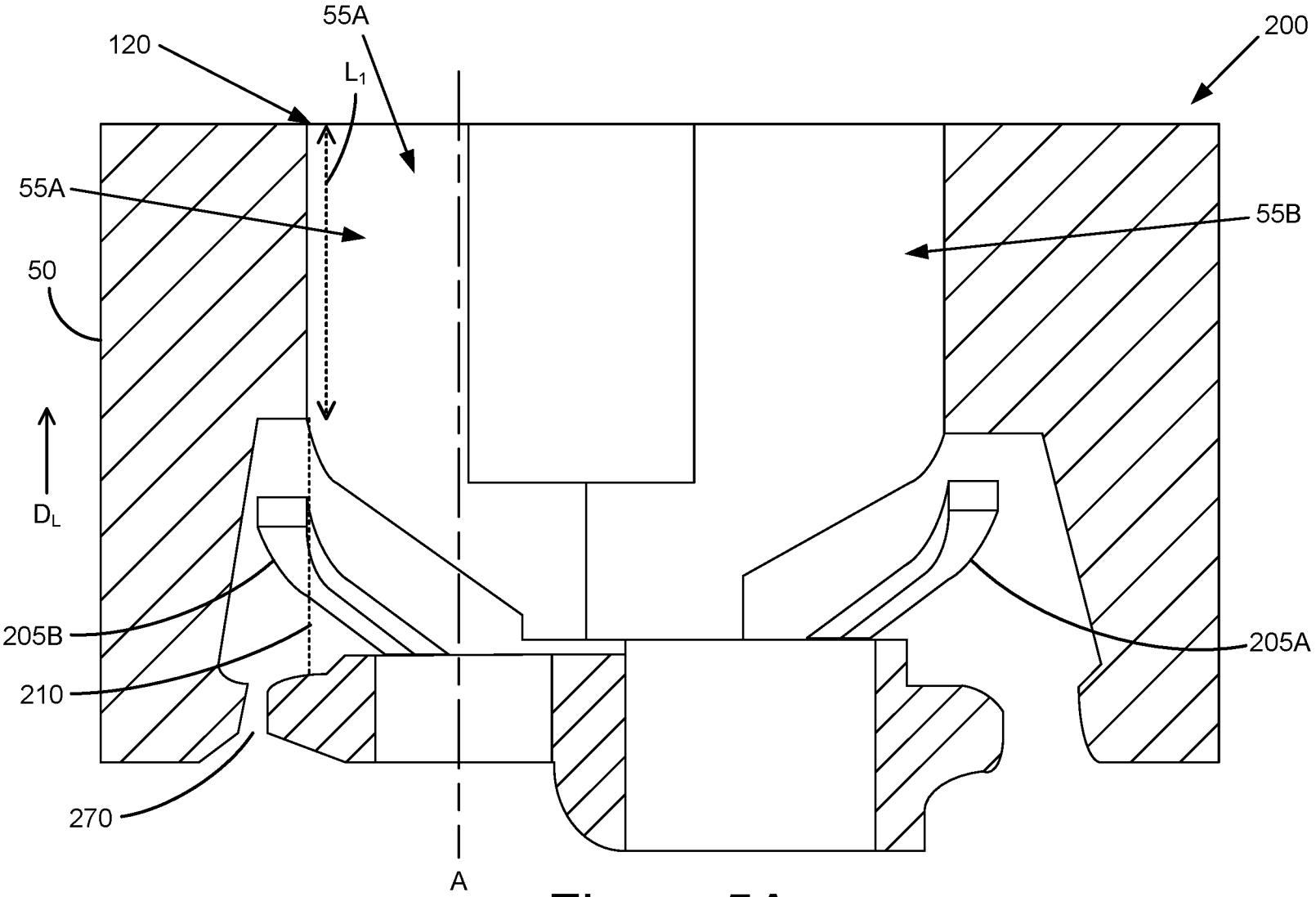
FIGS. 5A and 5B illustrate a valve assembly, according to an embodiment.
Figure 5B:
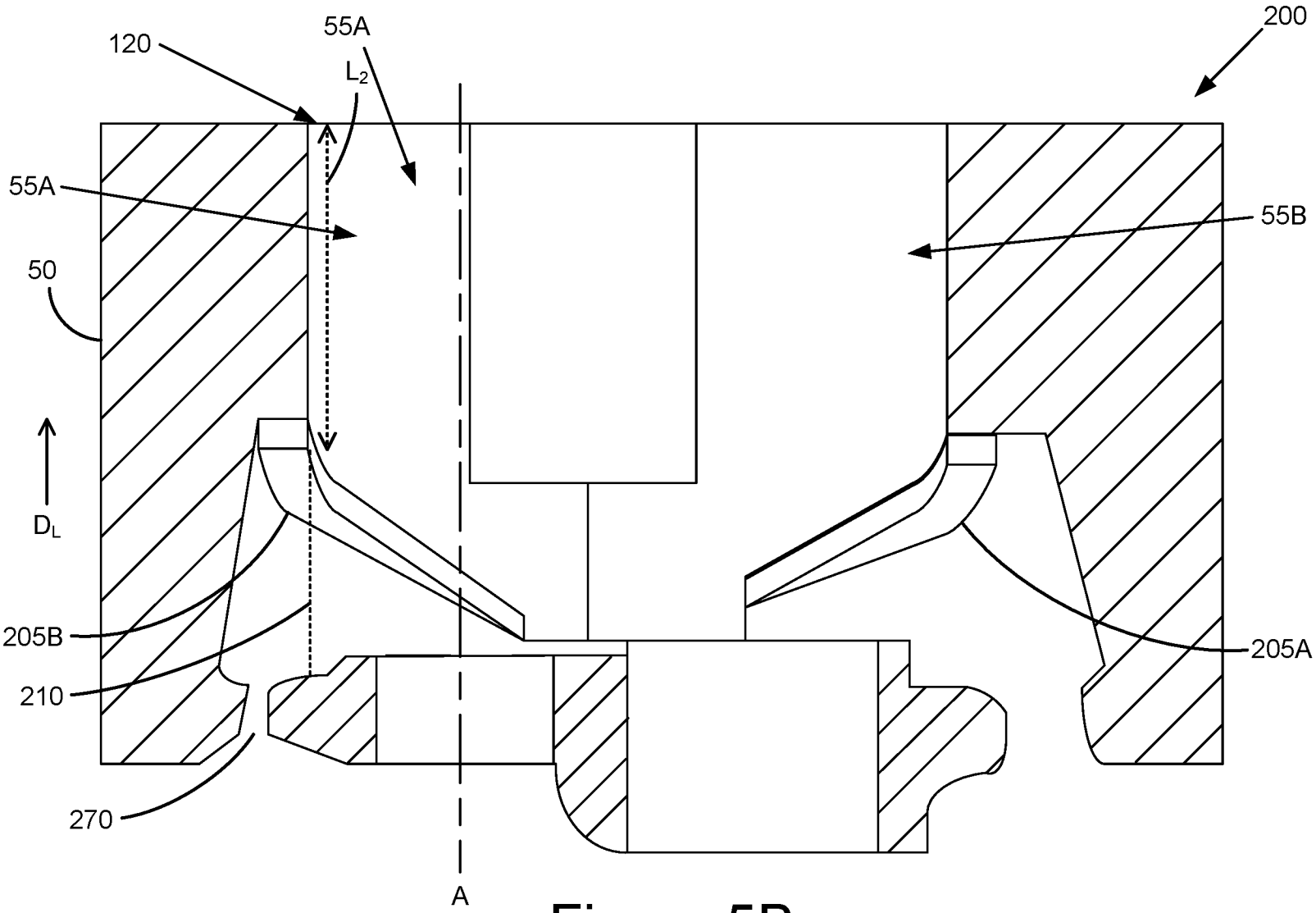

FIGS. 5A and 5B illustrate a valve assembly 200, according to an embodiment. The valve assembly 200 can, for example, be utilized to modify a volume ratio of a screw compressor (e.g., the screw compressor 35 in FIG. 2). In an embodiment, the screw compressor 35 having the valve assembly 200 can be included in a refrigerant circuit, such as the compressor 15 in the refrigerant circuit 10 of FIG. 1. As shown in FIGS. 5A and 5B, the screw compressor 35 includes an inlet port 270 that receives the working fluid to be compressed.

The valve assembly 200 can be included in the screw compressor 35 to modify a volume ratio of the screw compressor 35 at the suction side of the screw compressor 35. The valve assembly 200 can be used as an alternative to the valve assembly 100 (FIG. 3A, 3B) or the valve assembly 150 (FIGS. 4A-4C). In an embodiment, the valve assembly 200 can vary a location of a radial suction port 210. In an embodiment, the valve assembly 200 can be used in conjunction with the valve assembly 100 or the valve assembly 150. However, a complexity of the screw compressor 35 in such an embodiment may be increased.

The valve assembly 200 is movable to select a location of a radial suction port 210, according to an embodiment. In an embodiment, varying the location at which compression begins can, for example, reduce an amount of overcompression of the working fluid when operating the screw compressor 35 at a part load operating condition.

In an embodiment, the valve assembly 200 has two functional positions. At a first position (as illustrated in FIG. 5A), the compression process is delayed, resulting in a relatively lower volume ratio for the screw compressor 35. As the compression process is delayed, the working fluid is compressed for a relatively shorter longitudinal length $L_1$ in the first position. At a second position (as illustrated in FIG. 5B), the compression process begins relatively earlier than shown in FIG. 5A, resulting in a relatively higher volume ratio for the screw compressor 35. As the compression begins relatively earlier, the working fluid is compressed for a relatively longer longitudinal length $L_2$ in the second position. The longitudinal length $L_1$, $L_2$ along which the working fluid is compressed is longer in the second position than in the first position. In an embodiment, the screw compressor 35 with the valve assembly 200 in the first position can have a relatively lower capacity than the screw compressor with the valve assembly 200 in the second position. The variation in capacity may be relatively limited. For example, the capacity may vary between the first position and the second position by at or about 10 to at or about 20%.

In operation, the valve assembly 200 can be used to control a location at which the working fluid begins the compression process. There may be two positions (e.g., the first position and the second position) for the valve assembly 200. Intermediate positions between the first and second position may, for example, not provide a benefit, but instead cause leakage of the working fluid.

A discharge pressure $P_D$ can be used to determine a location of the valve assembly 200. In an embodiment, when a discharge pressure $P_D$ is relatively lower, the valve assembly 200 may be disposed in the first position so that the compression process is delayed. As the discharge pressure $P_D$ increases, the valve assembly 200 can be moved toward the second position so that the compression process is not delayed (e.g., begins sooner).

In an embodiment, the valve assembly 200 can be controlled passively. In an embodiment, the valve assembly 200 can be controlled actively, with an actuation mechanism other than the discharge pressure $P_D$.

In the illustrated embodiment, the valve assembly 200 includes first and second rotor sealing members 205A, 205B on the suction side relative to the discharge end 120. The rotor sealing members 205A, 205B can be moved between the first position and the second position to control the volume ratio of the screw compressor 35. As shown in FIGS. 5A and 5B, each of the rotor sealing members 205A, 205B is spaced apart in a longitudinal direction DL from the discharge end 120 of the rotor housing 50 in both the first position and the second position. In an embodiment, the first and second rotor sealing member 205A, 205B includes a profile that generally follows that of the bores (e.g., bores 55A, 55B) of rotor housing 50.

When the valve assembly 200 is in the first position, the screw compressor 35 has a relatively lower volume ratio. In an embodiment, the lower volume ratio can reduce an amount of working fluid that is overcompressed when the screw compressor 35 is operating at a part load condition.

Aspects: It is noted that any of aspects 1-7 below can be combined with any of aspects 8-12 and 13-19. Any of aspects 8-12 can be combined with any of aspects 13-19.

Aspect 1. A screw compressor, comprising: a suction inlet that receives a working fluid to be compressed; a compression mechanism fluidly connected to the suction inlet that compresses the working fluid; a discharge outlet fluidly connected to the compression mechanism that outputs the working fluid following compression by the compression mechanism; and a valve assembly configured to vary a location at which the compression mechanism compresses the working fluid, the valve assembly being disposed to modify a suction location of the screw compressor.

Aspect 2. The screw compressor of aspect 1, wherein the location at which the compression mechanism receives the working fluid is variable for an axial suction port.

Aspect 3. The screw compressor of one of aspects 1 or 2, wherein the valve assembly is a slide piston assembly configured to move in a direction that is parallel to a longitudinal axis of the compression mechanism.

Aspect 4. The screw compressor of one of aspects 1-3, wherein the valve assembly is configured to move in a direction that is perpendicular to a longitudinal axis of the compression mechanism.

Aspect 5. The screw compressor of one of aspects 1-4, wherein the valve assembly is configured to adjust a location of a radial suction port.

Aspect 6. The screw compressor of one of aspects 1-5, further comprising a variable frequency drive.

Aspect 7. The screw compressor of one of aspects 1-6, wherein the valve assembly is actuatable based on a discharge pressure of the screw compressor.

Aspect 8. A method of modifying a volume ratio of a screw compressor, comprising: determining a discharge pressure of the screw compressor; and modifying a location of a suction port of the screw compressor in response to the discharge pressure of the screw compressor as determined, wherein at a relatively higher discharge pressure a suction port is disposed so that compression begins relatively sooner than at a relatively lower discharge pressure.

Aspect 9. The method of aspect 8, wherein modifying the location of the suction port includes modifying an axial suction port.

Aspect 10. The method of one of aspects 8 or 9, wherein modifying the location of the suction port includes modifying a radial suction port.

Aspect 11. The method of one of aspects 8-10, wherein modifying the location of the suction port of the screw compressor includes actuating a valve assembly between a first position and a second position, wherein at the relatively higher discharge pressure, the valve assembly is actuated to the second position.

Aspect 12. The method of aspect 11, wherein in the first position, the screw compressor has a relatively lower volume ratio than in the second position.

Aspect 13. A refrigerant circuit, comprising: a compressor, a condenser, an expansion device, and an evaporator fluidly connected, wherein the compressor includes: a suction inlet that receives a working fluid to be compressed; a compression mechanism fluidly connected to the suction inlet that compresses the working fluid; a discharge outlet fluidly connected to the compression mechanism that outputs the working fluid following compression by the compression mechanism; and a valve assembly configured to vary a location at which the compression mechanism compresses the working fluid, the valve assembly being disposed to modify a suction location of the screw compressor.

Aspect 14. The refrigerant circuit of aspect 13, wherein the location at which the compression mechanism receives the working fluid is variable for an axial suction port.

Aspect 15. The refrigerant circuit of one of aspects 13 or 14, wherein the valve assembly is a slide piston assembly configured to move in a direction that is parallel to a longitudinal axis of the compression mechanism.

Aspect 16. The refrigerant circuit of one of aspects 13-15, wherein the valve assembly is configured to move in a direction that is perpendicular to a longitudinal axis of the compression mechanism.

Aspect 17. The refrigerant circuit of one of aspects 13-16, wherein the valve assembly is configured to adjust a location of a radial suction port.

Aspect 18. The refrigerant circuit of one of aspects 13-17, wherein the compressor further comprises a variable frequency drive.

Aspect 19. The refrigerant circuit of one of aspects 13-18, wherein the valve assembly is actuatable based on a discharge pressure of the screw compressor.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A screw compressor, comprising:

a suction inlet that receives a working fluid to be compressed;

a compression mechanism fluidly connected to the suction inlet that compresses the working fluid, the compression mechanism including one or more rotors;

a rotor housing containing the one or more rotors;

a discharge outlet fluidly connected to the compression mechanism that outputs the working fluid following compression by the compression mechanism; and a valve assembly including a rotor sealing member moveable relative to the rotor housing between a first position and a second position to modify a suction port of the compression mechanism based on a discharge pressure of the screw compressor, the second position disposing the rotor sealing member one or more of closer to a discharge end of the rotor housing than the first position or closer to the one or more rotors than the first position, wherein the rotor sealing member is spaced apart in a longitudinal direction from the discharge end of the rotor housing in both the first position and the second position, the longitudinal direction being parallel to a longitudinal axis of the compression mechanism, and a longitudinal length along which the compression mechanism compresses the working fluid in the second position is longer than a longitudinal length along which the compression mechanism compresses the working fluid in the first position.

2. The screw compressor of claim 1, wherein the suction port is an axial suction port, and the location at which the compression mechanism receives the working fluid is variable for the axial suction port.

3. The screw compressor of claim 1, wherein the valve assembly is a slide piston assembly configured to move in the longitudinal direction, and the second position disposes the rotor sealing member closer to the discharge end of the rotor housing than the first position.

4. The screw compressor of claim 1, wherein the rotor sealing member is configured to move in a direction that is perpendicular to the longitudinal axis of the compression mechanism, and the second position disposes the rotor sealing member closer to the one or more rotors than the first position.

5. The screw compressor of claim 1, wherein the suction port is a radial suction port, and the rotor sealing member is configured to adjust the location of the radial suction port.

6. The screw compressor of claim 1, further comprising an electric motor with a variable frequency drive.

7. A refrigerant circuit, comprising:

a screw compressor, a condenser, an expansion device, and an evaporator fluidly connected, wherein the screw compressor includes:

a suction inlet that receives a working fluid to be compressed;

a compression mechanism fluidly connected to the suction inlet that compresses the working fluid, the compression mechanism including one or more rotors;

a rotor housing, the one or more rotors disposed in the rotor housing;

a discharge outlet fluidly connected to the compression mechanism that outputs the working fluid following compression by the compression mechanism; and a valve assembly including a rotor sealing member moveable relative to the rotor housing between a first position and a second position to modify a suction port of the compression mechanism based on a discharge pressure of the screw compressor, and the second position disposing the rotor sealing member one or more of closer to a discharge end of the rotor housing than the first position or closer to the one or more rotors than the first position, wherein the rotor sealing member is spaced apart in a longitudinal direction from the discharge end of the rotor housing in both the first position and the second position, the longitudinal direction being parallel to a longitudinal axis of the compression mechanism, and a longitudinal length along which the compression mechanism compresses the working fluid is longer in the second position is longer than a longitudinal length along which the compression mechanism compresses the working fluid in the first position.

8. The refrigerant circuit of claim 7, wherein the suction port is an axial suction port, and the location at which the compression mechanism receives the working fluid is variable for the axial suction port.

9. The refrigerant circuit of claim 7, wherein the valve assembly is a slide piston assembly configured to move in a direction that is parallel to the longitudinal axis of the compression mechanism, and the second position disposes the rotor sealing member closer to the discharge end of the rotor housing than the first position.

10. The refrigerant circuit of claim 7, wherein the rotor sealing member is moveable in a direction that is perpendicular to the longitudinal axis of the compression mechanism, and the second position disposes the rotor sealing member closer to the one or more rotors than the first position.

11. The refrigerant circuit of claim 7, wherein the suction port is a radial suction port, and the rotor sealing member is configured to adjust the location of the radial suction port.

12. The refrigerant circuit of claim 7, wherein the screw compressor further comprises an electric motor with a variable frequency drive.

* * * * *